US009236017B2

(12) United States Patent
Park

(10) Patent No.: US 9,236,017 B2
(45) Date of Patent: Jan. 12, 2016

(54) DISPLAY DEVICE AND LUMINANCE CONTROL METHOD THEREOF

(71) Applicant: LG ELECTRONICS INC., Seoul (KR)

(72) Inventor: Sungjin Park, Pyeongtaek-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/143,521

(22) Filed: Dec. 30, 2013

(65) Prior Publication Data

US 2015/0062186 A1 Mar. 5, 2015

(30) Foreign Application Priority Data

Sep. 2, 2013 (KR) ..... 10-2013-0105127

(51) Int. Cl.
*G09G 3/32* (2006.01)
*G09G 3/36* (2006.01)

(52) U.S. Cl.
CPC ..... *G09G 3/3648* (2013.01); *G09G 3/3208* (2013.01); *G09G 3/3225* (2013.01)

(58) Field of Classification Search
None
See application file for complete search history.

(56) References Cited

U.S. PATENT DOCUMENTS

| | | | | |
|---|---|---|---|---|
| 7,093,941 | B2 | 8/2006 | Kawashima et al. | 353/97 |
| 2003/0189558 | A1* | 10/2003 | Aoki et al. | 345/204 |
| 2011/0205442 | A1* | 8/2011 | Mori et al. | 348/673 |
| 2015/0062187 | A1* | 3/2015 | Park | G09G 3/3225 345/690 |

FOREIGN PATENT DOCUMENTS

| | | | |
|---|---|---|---|
| JP | 2000-039862 | A | 2/2000 |
| JP | 2002-357810 | A | 12/2002 |
| JP | 2006-251819 | A | 9/2006 |
| JP | 2011-128182 | A | 6/2011 |
| KR | 10-2010-0020242 | A | 2/2010 |

OTHER PUBLICATIONS

International Search Report dated May 27, 2014 issued in Application No. PCT/KR2013/011611.

* cited by examiner

*Primary Examiner* — Joseph Haley
(74) *Attorney, Agent, or Firm* — Ked & Associates, LLP

(57) ABSTRACT

A display device and a method for controlling a luminance of the display device are disclosed. The display device includes an average picture level (APL) calculator which calculates an APL of an input image and outputs the APL of the input image and an APL curve data, a luminance adjuster which adjusts the APL curve data and includes at least two luminance adjusting units which are enabled in response to a user input through a user interface, a data modulator for modulating data of the input image using a luminance defined in the APL curve data adjusted by the luminance adjuster, and a display panel driving circuit which writes data from the data modulator on a display panel and reproduces the input image on the display panel.

16 Claims, 18 Drawing Sheets

| | |
|---|---|
| Vivid | 100 |
| Standard | 70 |
| Cinema | 30 |
| Game | 60 |

| | |
|---|---|
| Vivid | Off |
| Standard | Low |
| Cinema | Off |
| Game | Off |

DISPLAY DEVICE AND LUMINANCE CONTROL METHOD THEREOF

This application claims the benefit of Korean Patent Application No. 10-2013-0105127 filed on Sep. 2, 2013, the entire contents of which is incorporated herein by reference for all purposes as if fully set forth herein.

BACKGROUND OF THE INVENTION

1. Field of the Invention

Embodiments of the invention relate to a display device and a method for controlling a luminance of the display device.

2. Discussion of the Related Art

Examples of a flat panel display include a liquid crystal display (LCD), a plasma display panel (PDP), an organic light emitting display, and an electrophoresis display (EPD). The liquid crystal display displays an image by controlling an electric field applied to liquid crystal molecules based on a data voltage. An active matrix liquid crystal display has advantages of a reduction in the production cost and an improvement of a performance with the development of the process technology and the driving technology. Thus, the active matrix liquid crystal display is the most widely used display device applied to almost all display devices including small mobile equipments and large-sized televisions.

Because the organic light emitting display is a self-emitting device, it has advantages of lower power consumption and thinner profile than the liquid crystal display requiring a backlight unit. Further, the organic light emitting display has advantages of a wide viewing angle and a fast response time. Thus, the organic light emitting display has expanded its market while competing with the liquid crystal display.

Each pixel of the organic light emitting display includes an organic light emitting diode (OLED) having a self-emitting structure. As shown in FIG. 1, the OLED includes organic compound layers, such as a hole injection layer HIL, a hole transport layer HTL, an emission layer EML, an electron transport layer ETL, and an electron injection layer EIL, which are stacked between an anode and a cathode. The organic light emitting display reproduces an input image using a phenomenon in which the OLED emits light when electrons and holes are combined in an organic layer of the OLED through a current flowing in a fluorescence or phosphorescence organic thin film.

The organic light emitting display may be variously classified depending on a light emitting material, a light emitting manner, a light emitting structure, a driving method, etc. The organic light emitting display may be classified into a fluorescence emission type and a phosphorescence emission type depending on the light emitting manner, and may be classified into a top emission type and a bottom top emission type depending on the light emitting structure. Further, the organic light emitting display may be classified into a passive matrix OLED (PMOLED) type and an active matrix OLED (AMOLED) type depending on the driving method.

It is necessary to reduce a luminance of a screen greatly affecting the power consumption so as to efficiently reduce the power consumption of the display device. The power consumption may be reduced through a simple method for reducing the luminance of the screen, but the image quality may be degraded.

SUMMARY OF THE INVENTION

Embodiments of the invention provide a display device and a method for controlling a luminance of the display device capable of minimizing a reduction in image quality and reducing power consumption.

In one aspect, there is a display device comprising an average picture level (APL) calculator configured to calculate an APL of an input image and output the APL of the input image and an APL curve data, a luminance adjuster including at least two luminance adjusting units, which are enabled in response to a user input through a user interface, the luminance adjuster adjusting the APL curve data, a data modulator configured to modulate data of the input image using a luminance defined in the APL curve data adjusted by the luminance adjuster, and a display panel driving circuit configured to write data from the data modulator on a display panel and reproduce the input image on the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

In the following description, exemplary embodiments of the invention will be described using an organic light emitting display as an example of a flat panel display. Other types of flat panel displays may be used.

Figure 2:
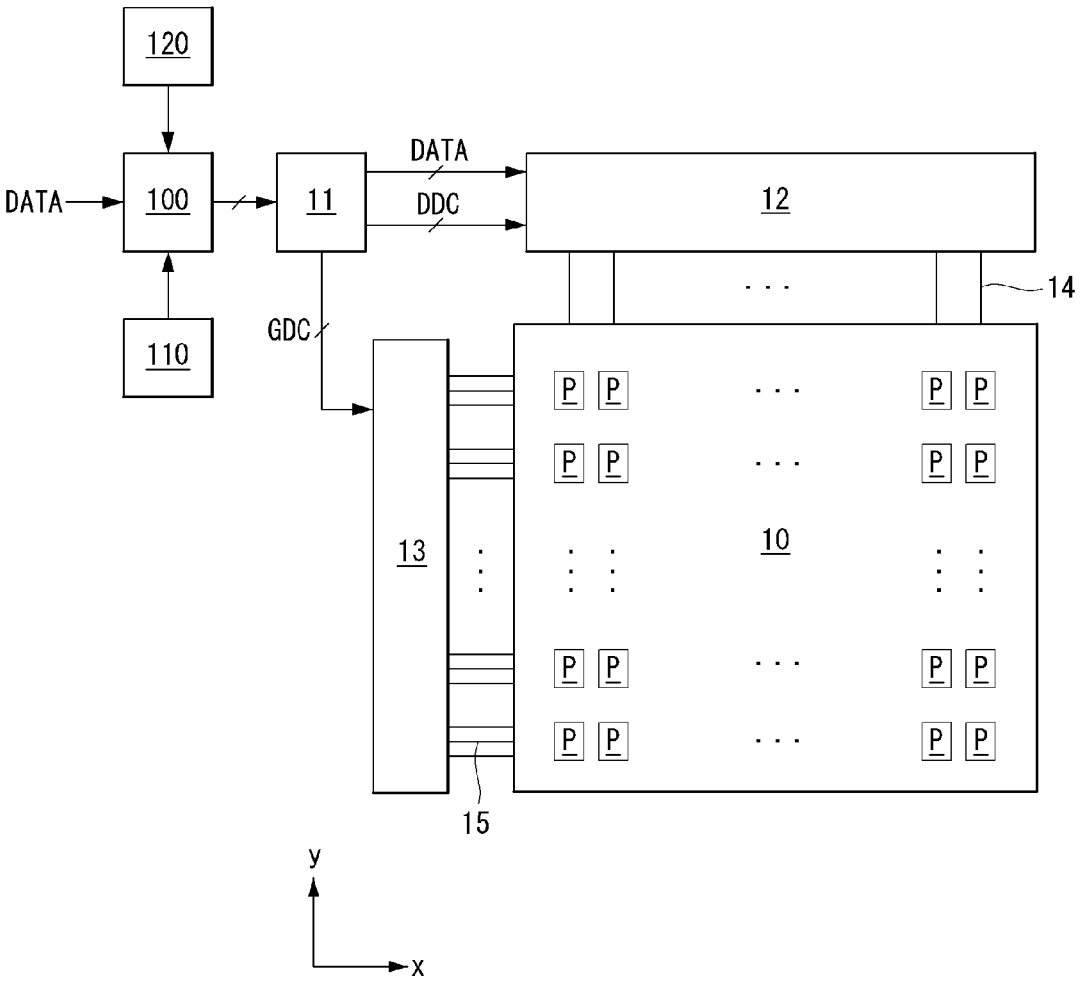
FIG. 2 is a block diagram of an organic light emitting display according to an exemplary embodiment of the invention.
Figure 3:
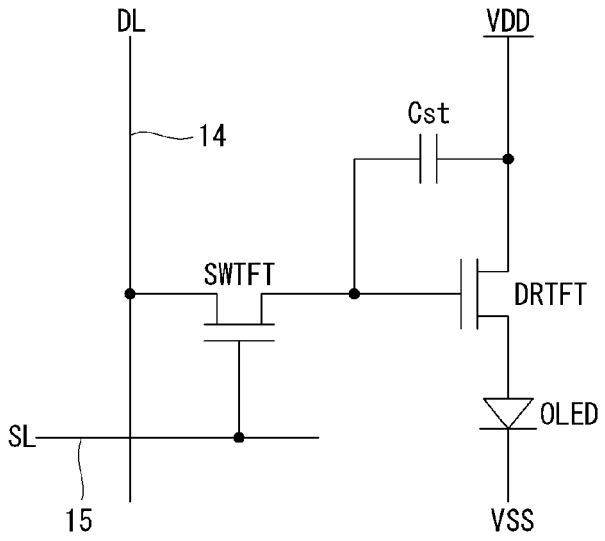
FIG. 3 is an equivalent circuit diagram of a pixel shown in FIG. 2.

As shown in FIGS. 2 and 3, an organic light emitting display according to an exemplary embodiment of the invention includes a display panel 10, a display panel driving circuit, a timing controller 11, a host system 100, etc.

Figure 1:
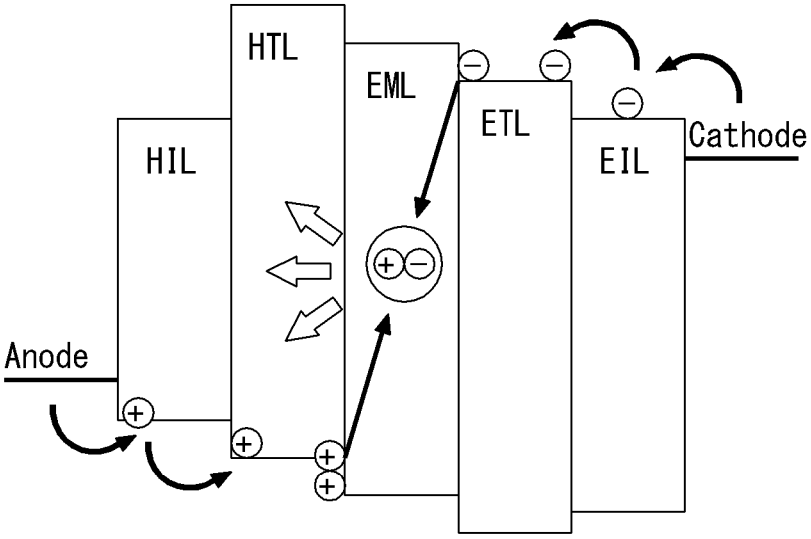
FIG. 1 (RELATED ART)
FIG. 1 shows a structure and an emission principle of an organic light emitting diode (OLED)

The display panel 10 includes a plurality of data lines 14 and a plurality of gate lines 15 crossing the data lines 14. A pixel array of the display panel 10 includes pixels P which are disposed in a matrix form and display an input image. As shown in FIG. 3, each pixel P includes an organic light emitting diode (OLED), a switching element SWTFT, a driving element DRTFT, a storage capacitor Cst, etc. The switching element SWTFT and the driving element DRTFT may be implemented as a thin film transistor (TFT). As shown in FIG. 1, the OLED may include organic compound layers, such as a hole injection layer HIL, a hole transport layer HTL, an emission layer EML, an electron transport layer ETL, and an electron injection layer EIL, which are stacked between an anode and a cathode. The switching element SWTFT applies a data voltage input through the data line 14 to a gate of the driving element DRTFT in response to a gate pulse. A gate of the switching element SWTFT is connected to the gate line 15. A drain of the switching element SWTFT is connected to the data line 14, and a source of the switching element SWTFT is connected to the gate of the driving element DRTFT. The driving element DRTFT adjusts a current flowing in the OLED depending on a gate voltage. A high potential power voltage VDD for driving the pixel is applied to a drain of the driving element DRTFT. A source of the driving element DRTFT is connected to the anode of the OLED. The storage capacitor Cst is connected between the gate and the drain of the driving element DRTFT. The anode of the OLED is connected to the source of the driving element DRTFT, and the cathode of the OLED is connected to a ground level voltage source GND. Each pixel P may additionally include an internal compensation circuit (not shown). The internal compensation circuit compensates for changes in a threshold voltage and a mobility of the driving element DRTFT The display panel driving circuit includes a data driving circuit 12 and a gate driving circuit 13. The display panel driving circuit writes data of the input image modulated by the timing controller 11 on the display panel 10 and reproduces the input image on the display panel 10.

The data driving circuit 12 includes at least one source driver integrated circuit (IC). The data driving circuit 12 converts pixel data DATA of the input image received from the timing controller 11 into analog gamma compensation voltage and generates the data voltage. The data driving circuit 12 outputs the data voltage to the data lines 14. The pixel data DATA input to the data driving circuit 12 is digital video data of the input image. Each pixel data DATA includes red data, green data, and blue data.

The gate driving circuit 13 supplies a gate pulse (or a scan pulse) synchronized with an output voltage of the data driving circuit 12 to the gate lines 15 under the control of the timing controller 11. The gate driving circuit 13 sequentially shifts the gate pulse and sequentially selects the pixels P, on which the data is written, on a per line basis.

The host system 100 may be implemented as one of a television system, a set-top box, a navigation system, a DVD player, a Blu-ray player, a personal computer (PC), a home theater system, and a phone system. The host system 100 calculates an average picture level (hereinafter referred to as "APL") in each frame of the input image. The host system 100 performs at least one luminance adjusting unit selected depending on a user input through a user interface (UI) 110 and adjusts an APL curve. The host system 100 produces data APL' of the APL curve and transmits the APL curve data APL' to the timing controller 11. The APL curve data APL' may be 8-bit data.

The APL curve data APL' output from the host system 100 may be transmitted to the timing controller 11 in a vertical blank period of each frame period. The vertical blank period is a period between an Nth frame period and an (N+1)th frame period, where N is a positive integer. There is no data in the vertical blank period.

The timing controller 11 receives the pixel data DATA of the input image, the APL curve data APL', and timing signals from the host system 100. The timing controller 11 modulates gray levels of the pixel data DATA, so that a luminance of the input image is limited to a luminance equal to or less than a maximum luminance defined in the APL curve data APL'. Further, the timing controller 11 generates timing control signals DDC and GDC for controlling operation timings of the data driving circuit 12 and the gate driving circuit 13 based on the timing signals received along with the pixel data DATA of the input image. The timing signals input to the timing controller 11 include a vertical sync signal Vsync, a horizontal sync signal Hsync, a data enable signal DE, and a main clock CLK, etc.

The timing controller 11 modulates the pixel data DATA of the input image based on a luminance defined in the APL curve data APL' received from the host system 100 using a data modulator 20 and transmits the modulated pixel data DATA to the data driving circuit 12. The data modulator 20 may be implemented as a lookup table LUT. The data modulator 20 modulates the pixel data DATA of the input image and may adjust a luminance or a color temperature of a display image displayed on the display panel 10. The lookup table LUT receives the APL curve data APL' and the pixel data DATA of the input image and outputs a modulation value previously stored in an address which the input data indicates, thereby modulating the gray levels of the pixel data DATA. The modulation value of the lookup table LUT is individually set based on each APL curve data APL' and also is individually set based on each gray level of the pixel data DATA. Hence, the luminance of the pixel data DATA is set to be equal to or less than the maximum luminance defined in the APL curve data APL'.

The user interface 110 may be implemented as a keypad, a keyboard, a mouse, an on-screen display (OSD), a remote controller having an infrared communication function or a radio frequency (RF) communication function, a touch UI, a voice recognition UI, a 3D UI, etc.

The host system 100 may be connected to a sensing unit 120. The sensing unit 120 includes an image sensor (or a camera), an illuminance sensor, a color temperature sensor, a microphone, an acceleration sensor, a gravity sensor, a proximity sensor, a terrestrial magnetism sensor, a gyroscope angular velocity sensor, etc. The sensing unit 120 converts the outputs of these sensors into digital data and supplies the digital data to the host system 100. The color temperature sensor senses a color temperature using a red light sensor, a green light sensor, and a blue light sensor. The host system 100 may control the luminances of the pixels in response to the outputs of the sensors. For example, the host system 100 analyzes the output of the illuminance sensor and decides an illuminance of a surrounding environment of the display device. The host system 100 may adjust the APL curve depending on the illuminance of the surrounding environment. Further, the host system 100 adjusts a white balance value of the pixel depending on a color temperature of the surrounding environment and may adjust a color temperature of the display image.

Figure 4:
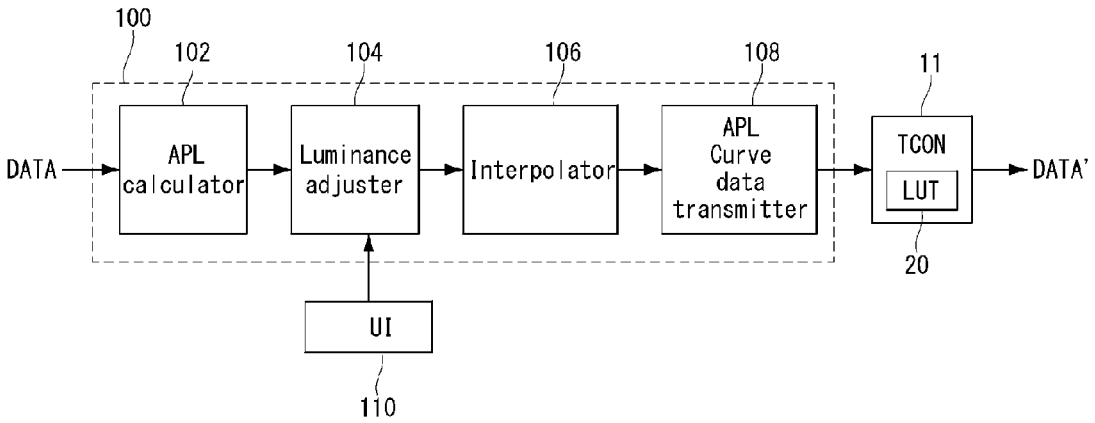
FIG. 4 is a block diagram of a graphic controller of a host system.
Figure 5:
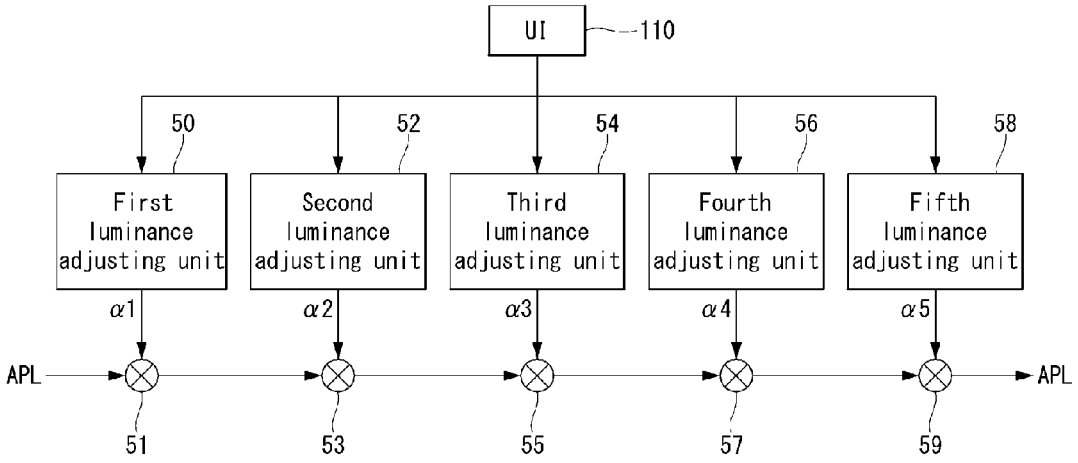
FIG. 5 is a block diagram showing in detail a luminance adjuster shown in FIG. 4.
Figure 6:
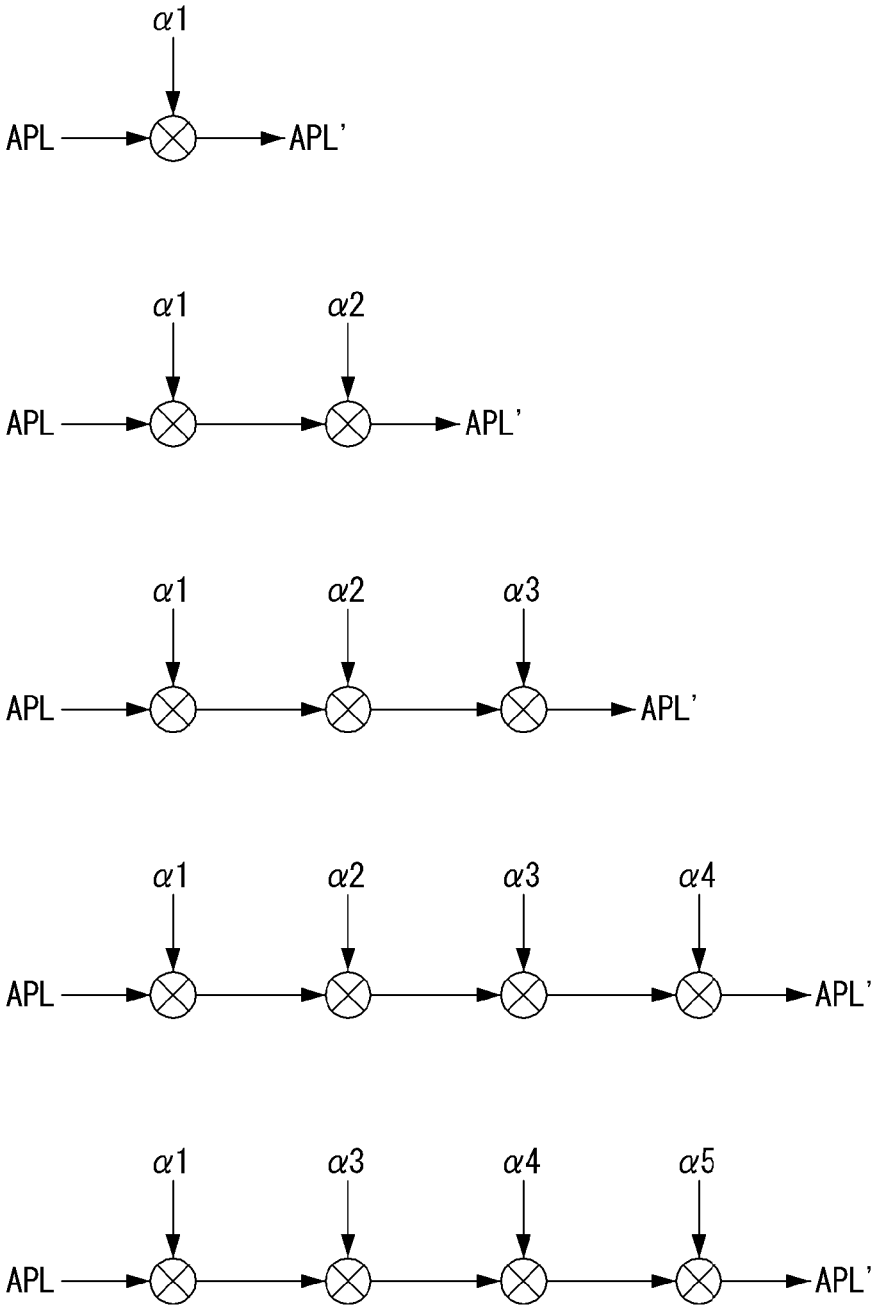
FIGS. 6 to 8 show various examples of a method for adjusting a luminance.
Figure 7:
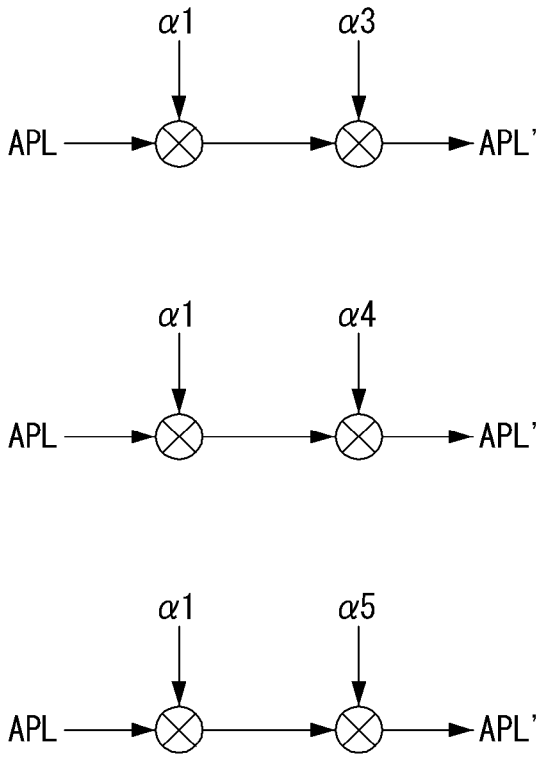
Figure 8:
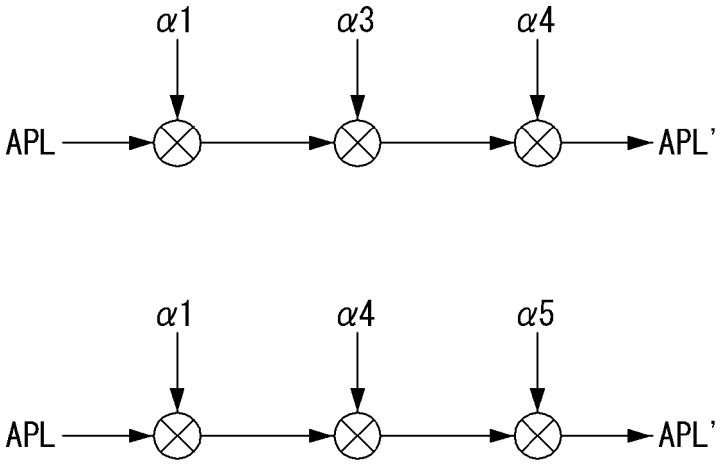

FIG. 4 is a block diagram of a graphic controller of the host system 100. FIG. 5 is a block diagram showing in detail a luminance adjuster shown in FIG. 4. FIGS. 6 to 8 show various examples of a method for adjusting a luminance.

As shown in FIGS. 4 to 8, a graphic controller of the host system 100 includes an APL calculator 102, a luminance adjuster 104, an interpolator 106, an APL curve data transmitter 108, etc.

The APL calculator 102 calculates the APL in each frame of the input image. The APL is an average luminance value of pixel data corresponding to one frame. In general, the high APL indicates a bright image, and the low APL indicates a dark image. The APL calculator 102 receives the APL curve data APL' from the timing controller 11 and supplies the APL curve data and the APL of the input image to the luminance adjuster 104. There may be a deviation in luminance, current, and driving characteristics of the display panel 10. The characteristic information of the display panel 10 is embedded in the timing controller 11. The APL curve data considering the characteristic deviation of the display panel 10 may be stored in the timing controller 11.

Alternatively, the APL calculator 102 may not receive the APL curve data from the timing controller 11 and may transmit the APL curve data APL' previously stored in a built-in memory to the luminance adjuster 104.

Figure 9:
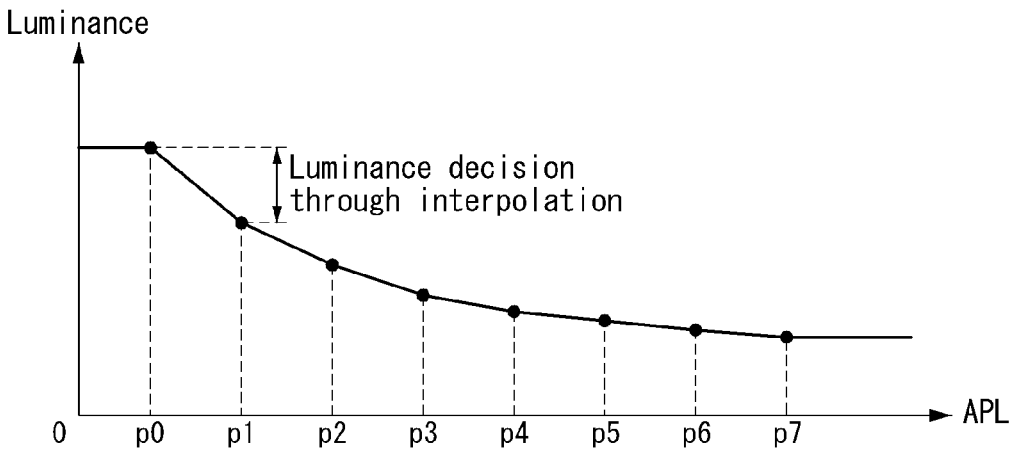
FIG. 9 shows average picture level (APL) points, which are positioned at regular intervals on an APL curve.

The APL curve data transmitted to the luminance adjuster 104 may include only N APL points p0 to p7 on the APL curve shown in FIG. 9, so as to reduce an operation amount of data, where N is a positive integer between 2 and 20. The N APL points p0 to p7 are points positioned at boundaries between neighboring sections when the APL curve is equally divided into N sections. In the APL curve shown in FIGS. 9 and 10, N is 8, for example.

The luminance adjuster 104 performs at least one luminance adjusting unit selected based on user input data input through the user interface 110 and adjusts the APL curve. According to the APL curve shown in FIGS. 9 and 10, the maximum luminance of the display image increases when the APL is reduced, and the maximum luminance of the display image is reduced when the APL increases. The timing controller 11 reduces the luminance of the display device based on the APL curve and may reduce the current flowing in the OLED of the pixel.

Figure 10:
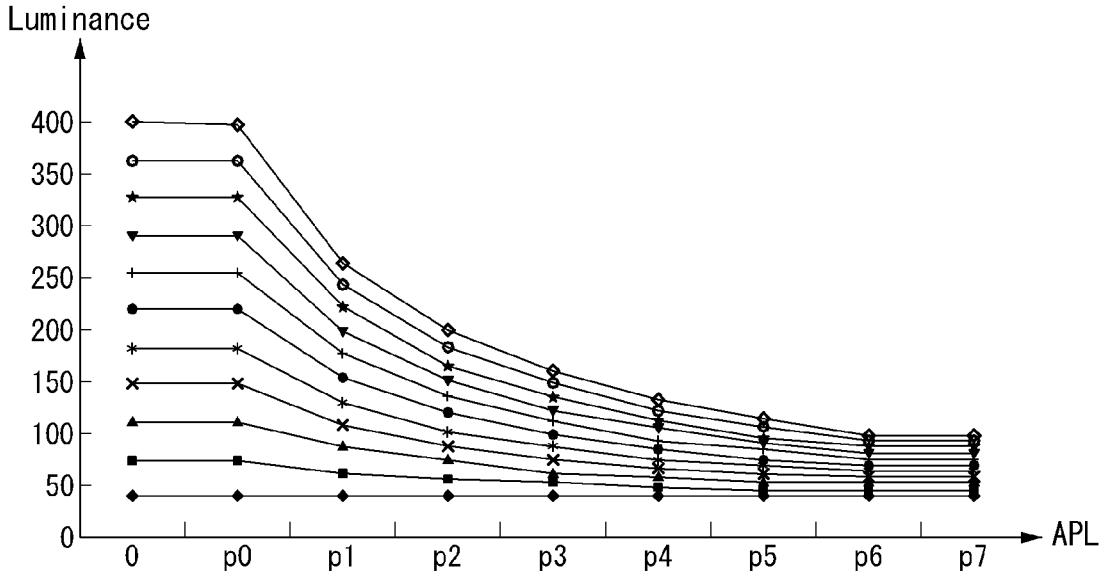
FIG. 10 shows an APL curve adjusted by a luminance adjuster shown in FIGS. 4 and 5.

The luminance adjuster 104 adjusts the APL curve data received from the APL calculator 102 and outputs the APL curve data APL' shown in FIG. 10. The APL curve defines the maximum luminance depending on the APL of the input image. According to the APL curve, when the APL of the input image is reduced, the maximum luminance of the display image increases. Further, when the APL of the input image increases, the maximum luminance of the display image is reduced. The host system 100 adjusts the APL curve using the luminance adjuster 104, thereby minimizing a reduction in the image quality. Further, the host system 100 may control power consumption at a level equal to or less than a predetermined level even if an average luminance of the input image changes.

The interpolator 106 calculates a luminance between luminances corresponding to the neighboring APL points p0 to p7 through a linear interpolation method. As a result, the interpolator 106 produces luminance data connecting the luminances corresponding to the neighboring APL points p0 to p7 and outputs the APL curve data APL' defining the maximum luminance of the display image on the entire APL curve. The APL curve data transmitter 108 transmits the APL curve data APL' received from the interpolator 106 to the timing controller 11. The data modulator 20 of the timing controller 11 modulates the pixel data of the input image based on the maximum luminance defined in the APL curve data APL' and thus may adjust the luminance or the color temperature of the display image. The data modulator 20 may be implemented as the lookup table LUT.

The luminance adjuster 104 may output the APL curve data defining the maximum luminance with respect to all of the APLs. In this instance, the interpolator 106 may be omitted, and the APL curve data output from the luminance adjuster 104 may be transmitted to the timing controller 11.

As shown in FIG. 5, the luminance adjuster 104 includes first to fifth luminance adjusting units 50, 52, 54, 56, and 58 and first to fifth multipliers 51, 53, 55, 57, and 59.

The first to fifth luminance adjusting units 50, 52, 54, 56, and 58 may be enabled to operate or disabled depending on the input of the user interface 110. The input of the user interface 110 may be maker input data input by a set maker manufacturing the display device and may be user input data using the display device.

Figure 12:
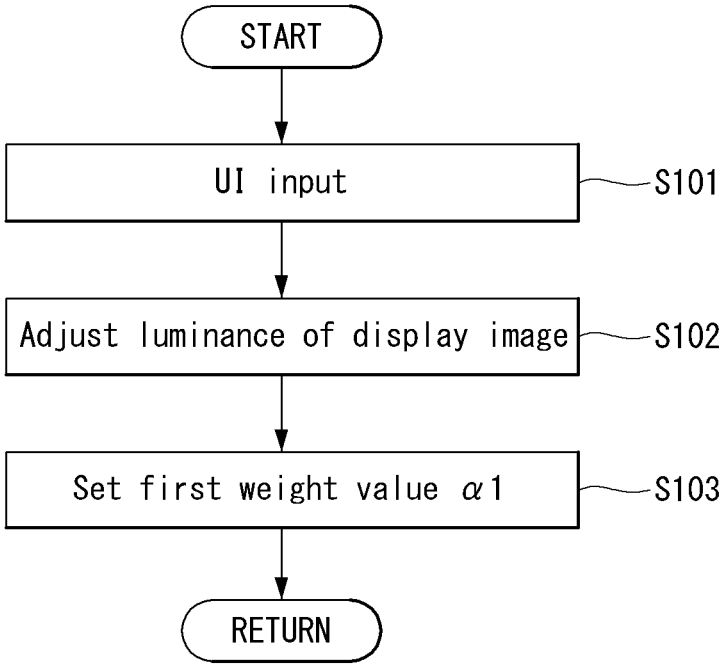
FIG. 12 is a flow chart showing an operation of a first luminance adjusting unit shown in FIG. 5.
Figures 13, 14:
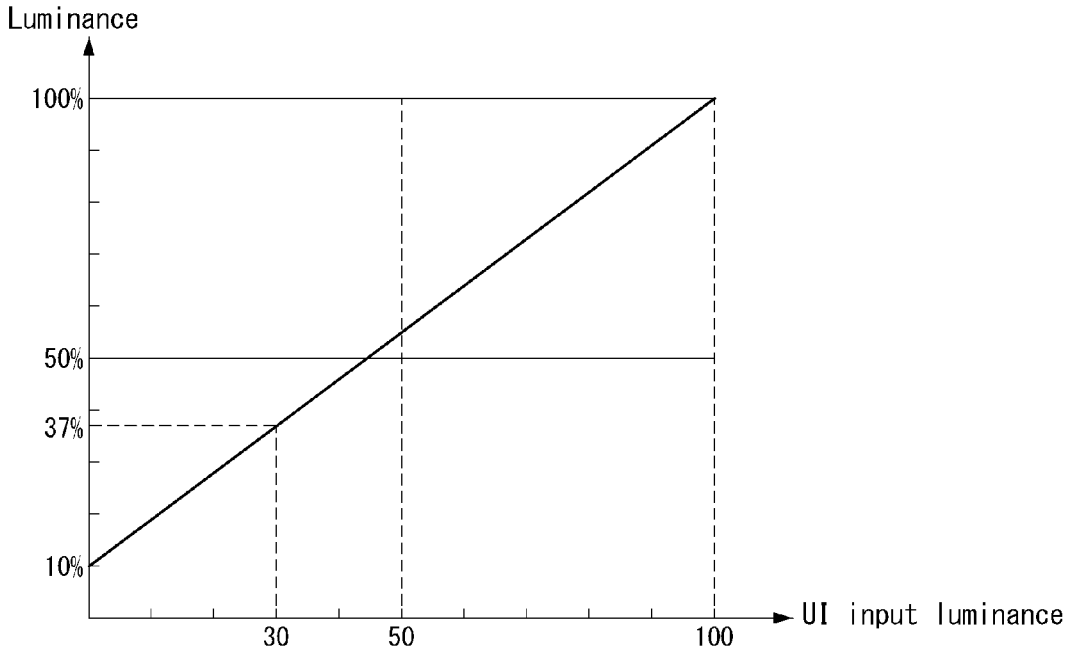
FIG. 13 shows a luminance of a display image adjusted depending on input luminance of an user interface.
FIG. 14 shows a maximum luminance of a display image defined in a picture sound mode.

The first luminance adjusting unit 50 receives the input of the user interface 110 and adjusts the luminance of the display image. As shown in FIGS. 12 and 13, the first luminance adjusting unit 50 sets a first weight value $\alpha 1$ in response to an UI input luminance input through the user interface 110 and adjusts the luminance of the display image. In this instance, when the UI input luminance is zero, the maximum luminance of the display image is limited to a value greater than zero. This is because a minimum luminance of the display image controlled by the third luminance adjusting unit 54 is greatly reduced when the first luminance adjusting unit 50 greatly reduces the maximum luminance of the display image. The first weight value $\alpha 1$ is set to be greater than zero and equal to or less than 1. The first multiplier 51 adjusts the luminances of the APL points p0 to p7 by multiplying the luminance of each of the APL points p0 to p7 by the first weight value $\alpha 1$.

A picture sound mode PSM may be set in the host system 100. As shown in FIG. 14, the first luminance adjusting unit 50 may adjust the maximum luminance of the display image based on the picture sound mode PSM.

The picture sound mode PSM defines various image modes, which the user can select, in consideration of a viewing environment and viewing conditions of the user using the display device. For example, the picture sound mode PSM may include a vivid mode, a standard mode, an eco mode, a cinema mode, a game mode, an expert mode, etc. which the user can select through the user interface 110. The user may select the image modes defined in the picture sound mode PSM through the user interface 110. The various image modes are described below.

The vivid mode is an image mode, in which the image quality is improved to the maximum so as to show a bright and vivid image in a store. The standard mode is a standard image mode, in which the user can comfortably use at the home. The eco mode is an image mode for optimizing a shipment mode and the power consumption. The cinema mode is an image mode optimized to watch a movie in darkroom condition. The game mode is an image mode (delay time optimization) optimized to play a game. The expert mode is an image mode for image quality experts.

In all of the image modes, a luminance of a black gray is the same, but a luminance of the maximum gray level (or peak white gray level) is differently set depending on the viewing environment and the viewing conditions of the user. Thus, the image modes defined in the picture sound mode PSM may differently set the maximum luminance and a contrast ratio of the display image. The vivid mode is the image mode capable of controlling the display image to the maximum brightness. Because the cinema mode and the expert mode are optimized image modes in a darkroom environment, the maximum luminance of the display image may be set to be dark.

A method for selecting the image mode in the picture sound mode PSM may be directly selected by the user. In the image mode which receives a sensor signal and decides the viewing environment, image quality setting values may be automatically set based on the surrounding environment. For example, when a peripheral illuminance of the display device is bright, the luminance and the contrast ratio of the display image may be automatically set to the maximum. On the other hand, when the peripheral illuminance of the display device is dark, the luminance of the display image may be reduced and may be automatically set, so that a sharpness value is reduced.

Figure 15:
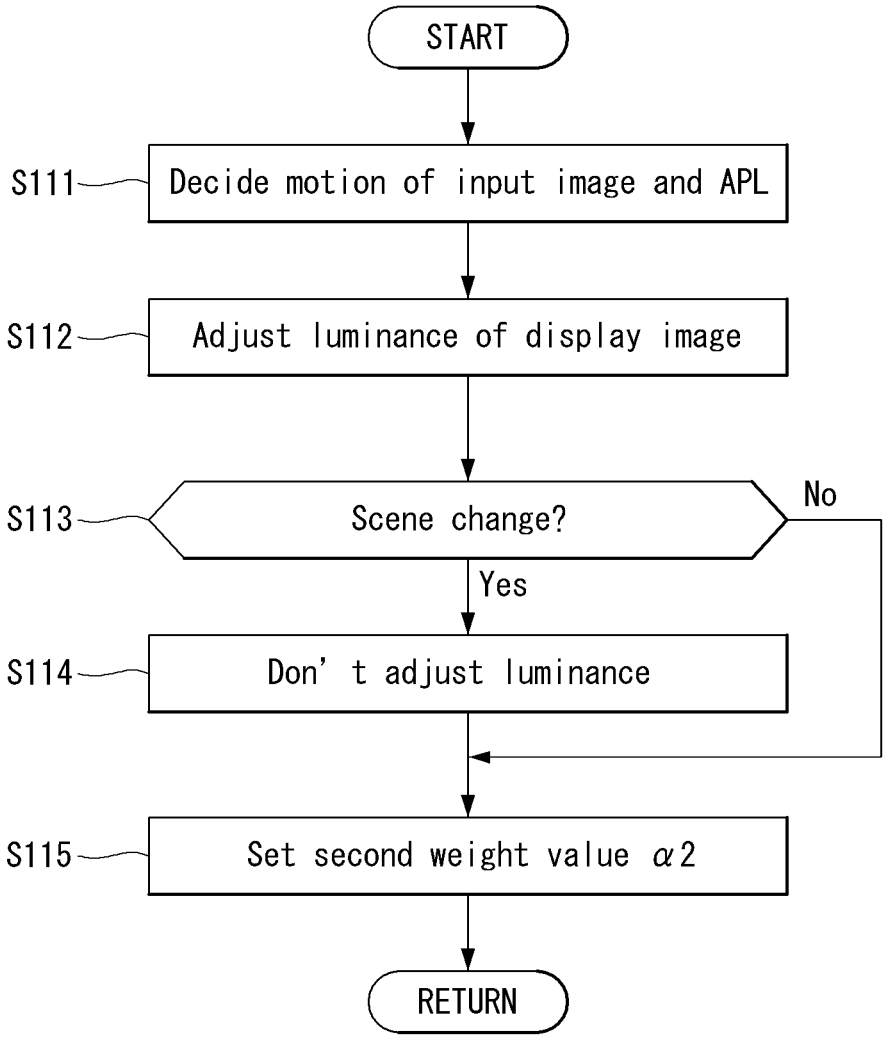
FIG. 15 is a flow chart showing an operation of a second luminance adjusting unit shown in FIG. 5.

The second luminance adjusting unit 52 receives the input of the user interface 110 and may be performed. As shown in FIG. 15, the second luminance adjusting unit 52 decides a motion of the input image and the APL received from the first luminance adjusting unit 50 and adjusts the luminance of the display image, thereby reducing the power consumption and preventing the user from glaring. The second luminance adjusting unit 52 adjusts the luminance of the display image using a second weight value $\alpha 2$. The second weight value $\alpha 2$ is set to be greater than zero and equal to or less than 1. The second multiplier 53 adjusts the luminances of the APL points p0 to p7 by multiplying the luminance of each of the APL points p0 to p7 received from the first multiplier 51 by the second weight value $\alpha 2$.

Figure 19:
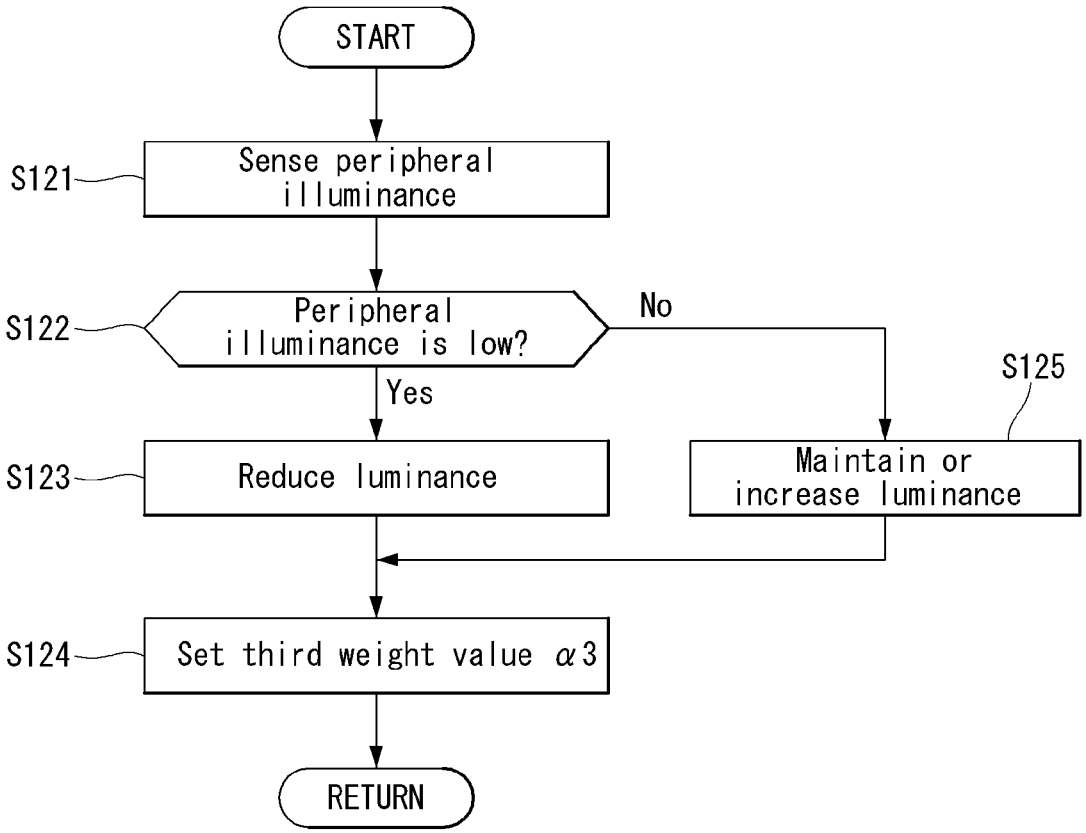
FIG. 19 is a flow chart showing an operation of a third luminance adjusting unit shown in FIG. 5.

The third luminance adjusting unit 54 receives the input of the user interface 110 and may be performed. As shown in FIG. 19, the third luminance adjusting unit 54 adjusts the luminance of the display image based on the peripheral illuminance of the display device, thereby reducing the power consumption and preventing the glare of the user. The third luminance adjusting unit 54 adjusts the luminance of the display image using a third weight value $\alpha 3$. The third weight value $\alpha 3$ is set to be greater than zero and equal to or less than 1. The third multiplier 55 adjusts the luminances of the APL points p0 to p7 by multiplying the luminance of each of the APL points p0 to p7 received from the first multiplier 51 or the second multiplier 53 by the third weight value $\alpha 3$.

Figure 21:
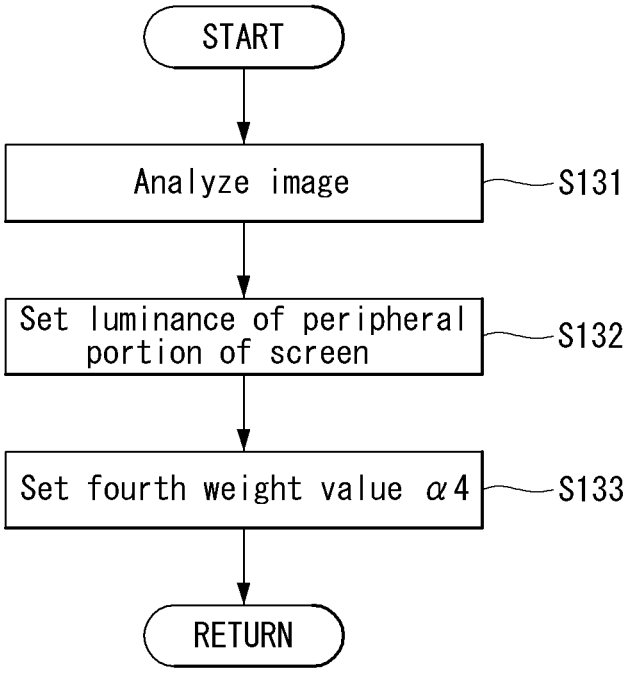
FIG. 21 is a flow chart showing an operation of a fourth luminance adjusting unit shown in FIG. 5.

The fourth luminance adjusting unit 56 receives the input of the user interface 110 and may be performed. The fourth luminance adjusting unit 56 reduces the power consumption by gradually reducing the luminance as it goes from a middle portion of the screen or the pixel array of the display panel 10 to a peripheral portion thereof. As shown in FIG. 21, the fourth luminance adjusting unit 56 outputs a fourth weight value $\alpha 4$ for adjusting a luminance of the peripheral portion of the screen of the display panel 10. The fourth weight value $\alpha 4$ is set to be greater than zero and equal to or less than 1. The fourth multiplier 57 adjusts the luminances of the APL points p0 to p7 by multiplying the luminance of each of the input APL points p0 to p7 by the fourth weight value $\alpha 4$. The input APL points p0 to p7 of the fourth multiplier 57 are received from the first multiplier 51, the second multiplier 53, or the third multiplier 55.

The fifth luminance adjusting unit 58 receives the input of the user interface 110 and may be performed. The fifth luminance adjusting unit 58 separately adjusts the luminance of the display image in a store mode and a home mode. The fifth luminance adjusting unit 58 causes the luminance of the display image in the store mode to be greater than the home mode because the lighting of the store, in which the display devices are displayed, is brighter than the indoor lighting of the home. The fifth luminance adjusting unit 58 outputs a fifth weight value $\alpha 5$, which is set to different values in the store mode and the home mode. If the luminance of the display image in the store mode is set to be greater than the home mode by about 20%, the fifth weight value $\alpha 5$ may be set to 1.2 in the store mode and may be set to 1.0 in the home mode. The fifth multiplier 59 adjusts the luminances of the APL points p0 to p7 by multiplying the luminance of each of the APL points p0 to p7 by the fifth weight value $\alpha 5$. The APL points p0 to p7 of the fifth multiplier 59 are received from one of the first to fourth multipliers 51, 53, 55, or 57.

The set maker or the user may select the second to fifth luminance adjusting units 52, 54, 56, and 58 through the user interface 110. The luminance adjuster 104 sequentially adjusts the luminances of the APL points using at least one weight value output from the luminance adjusting unit the user selects. For example, as shown in FIGS. 6 to 8, the APL point is multiplied by the first weight value and then may be multiplied by at least one of the second to fifth weight values.

Figure 11:
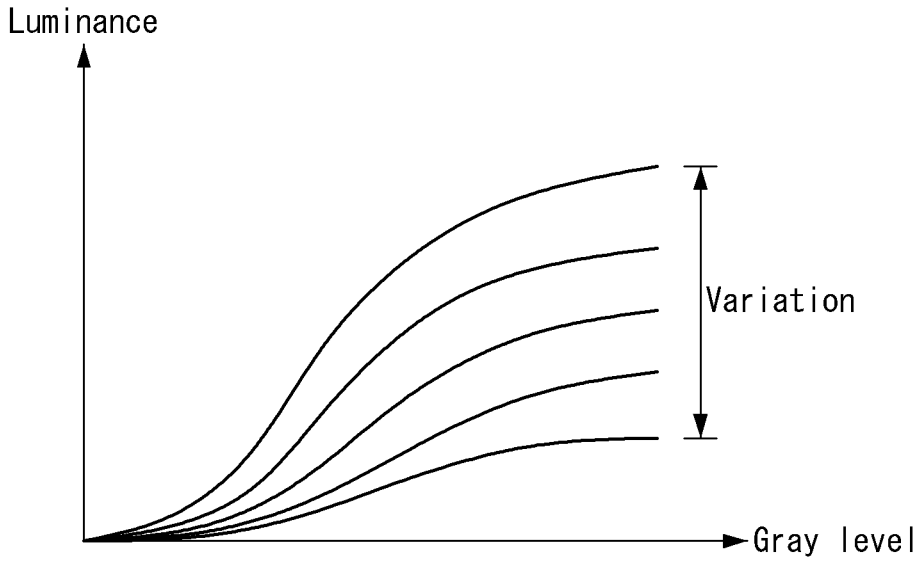
FIG. 11 is a graph showing a luminance of a display image adjusted based on an APL curve.

FIG. 9 shows APL points, which are positioned at regular intervals on the APL curve. FIG. 10 shows the APL curve adjusted by the luminance adjuster 104 shown in FIGS. 4 and 5. FIG. 11 is a graph showing the luminance of the display image adjusted based on the APL curve.

As shown in FIG. 9, when the APL curve is equally divided into the N sections, the APL curve date input to the luminance adjuster 104 may include only the N APL points p0 to p7 positioned at the boundaries between the neighboring sections. The luminance adjuster 104 adjusts the luminance of the APL at each of the N APL points p0 to p7 using the weight values $\alpha 1$ to $\alpha 5$, thereby reducing the luminance and the power consumption of the display image while minimizing a reduction in the image quality of the display image the user perceives. On the APL curve, the maximum luminance of the display image having a value equal to or less than the APL at the first APL point p0 is fixed to a maximum value. As the APL gradually increases to a value greater than the APL at the first APL point p0, the maximum luminance of the display image gradually is reduced. Further, the maximum luminance of the display image having a value greater than the APL at the eighth APL point p7 is fixed to a minimum value.

The luminance adjuster 104 multiply the luminance of the APL curve data by the weight value to adjust the APL curve data APL' as shown in FIG. 10. The luminance adjuster 104 transmits the APL curve data APL' to the timing controller 11 through a serial communication interface, for example, $I^2C$ communication. The timing controller 11 may transmit the luminance data of the APL points p0 to p7, which are previously determined through a test process so that the APL points p0 to p7 are optimized for the display panel, to the APL calculator 102 through the serial communication interface.

The timing controller 11 modulates the gray level of the pixel data using the maximum luminance of the display image defined in the APL curve data APL'. The luminance of the display image changes depending on the gray level of the pixel data along 2.2 gamma curve as shown in FIG. 11. The maximum luminance of the display image is equal to a maximum luminance defined in the APL curve data APL'.

FIGS. 12 to 14 show an operation of the first luminance adjusting unit 50.

As shown in FIGS. 12 to 14, the first luminance adjusting unit 50 adjusts the luminance of the display image in proportion to an input luminance (hereinafter referred to as "UI input luminance") of the user interface in steps S101 to 103. The first luminance adjusting unit 50 sets the first weight value $\alpha 1$ for adjusting the maximum luminance of the display image. The first luminance adjusting unit 50 limits the minimum value of the maximum luminance of the display image to a value greater than zero. For example, when the maximum luminance of the display image is 100%, the first luminance adjusting unit 50 may fix the maximum luminance of the display image to not a value equal to or less than 10% but a specific value equal to or greater than 10% even if the UI input luminance is equal to or less than 10%. The first weight value $\alpha 1$ increases in proportion to the UI input luminance. For example, the first weight value $\alpha 1$ is set to 0.1 when the UI input luminance is equal to or less than 10%. On the other hand, as the UI input luminance gradually increase to a value equal to or greater than 10%, the first weight value $\alpha 1$ may gradually increase within the range between 0.2 and 1.

The first luminance adjusting unit 50 may adjust the APL curve data using the maximum luminance of the display image optimized in each image mode included in the previously set picture sound mode PSM. For example, the picture sound mode PSM may include the vivid mode, the standard mode, the cinema mode, the game mode, etc. In the image modes, the maximum luminance and the contrast ratio of the display image may be differently set. As shown in FIG. 14, the maximum luminance of the display image may be set to 100% in the vivid mode, 70% in the standard mode, 30% in the cinema mode, and 60% in the game mode. The first luminance adjusting unit 50 may adjust the luminance of each image mode included in the picture sound mode PSM using the first weight value $\alpha 1$.

Figures 16, 17:
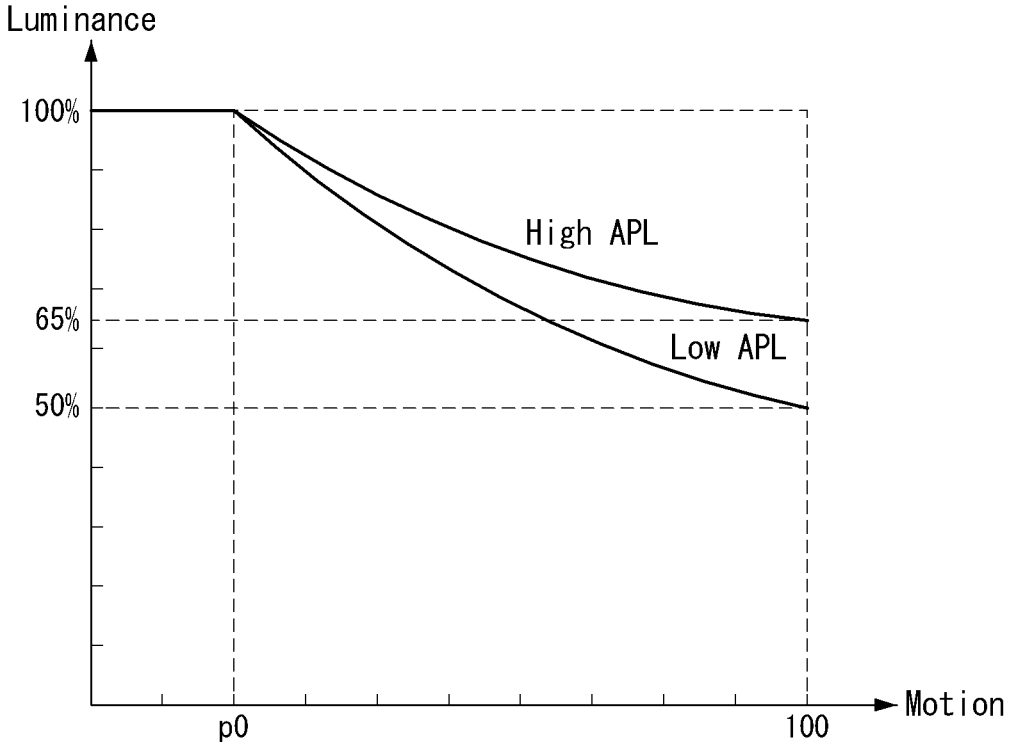
FIG. 16 shows a method for adjusting a maximum luminance of a display image depending on a motion and an APL of an input image.
FIG. 17 shows a luminance defined by each image mode included in a picture sound mode in a second luminance adjusting unit.

FIGS. 15 to 17 show an operation of the second luminance adjusting unit 52.

As shown in FIGS. 15 to 17, the second luminance adjusting unit 52 decides a motion of the input image and the input APL curve data and adjusts the luminance of the display image using the second weight value $\alpha 2$ in steps S111, S112, and S115. The second luminance adjusting unit 52 analyzes the input image using a known motion estimation/motion compensation (MEMC) algorithm and may decide the motion of the input image using a calculated motion vector. Further, the second luminance adjusting unit 52 may decide the motion of the input image using the motion vector received along with the input image. As shown in FIG. 16, the second luminance adjusting unit 52 reduces the maximum luminance of the display image using the second weight value $\alpha 2$ as the motion of the input image increases. In this instance, as the APL curve data is reduced, the maximum luminance of the display image is reduced. Hence, the maximum luminance of the display image at the low APL curve data is less than that at the high APL curve data. For example, as shown in FIG. 16, when the motion of the input image is 100, the second luminance adjusting unit 52 controls the maximum luminance of the display image at the low APL curve to 50% and controls the maximum luminance of the display image at the high APL curve to 65%. The second luminance adjusting unit 52 may not adjust the maximum luminance of the display image in the low APL section where the input APL is equal to or less than the first APL point p0.

The second luminance adjusting unit 52 may differently control the motion of the input image and the APL in each image mode included in the picture sound mode PSM. For example, the second luminance adjusting unit 52 controls the luminance of the display image based on the low APL curve shown in FIG. 16 in the standard mode and does not adjust the luminance of the display image in the vivid mode, the cinema mode, and the game mode.

Figure 18:
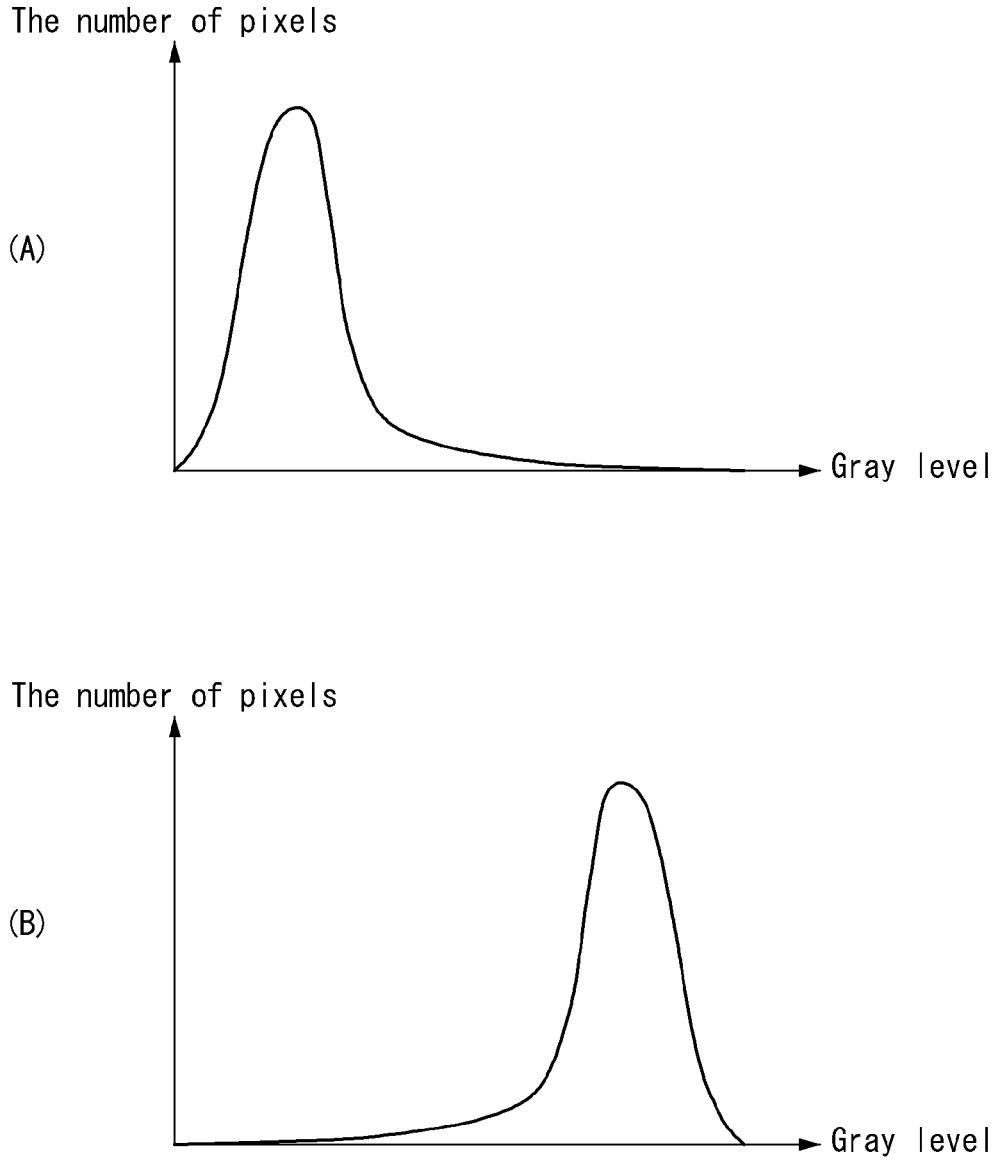
FIG. 18 shows an example of a histogram for deciding a scene change.

When the scene changes, the second luminance adjusting unit 52 does not adjust the luminance of the display image and maintains it in steps S113 and S114. This is because if the luminance of the display image is adjusted depending on the motion of the input image in the change of the scene, changes in the luminance of the display image may be greatly seen. The second luminance adjusting unit 52 calculates a histogram of the input image. Hence, when the histogram sharply changes as shown in (A) and (B) of FIG. 18, the second luminance adjusting unit 52 may decide the sharp change of the histogram as timing of the scene change. The second luminance adjusting unit 52 sets the second weight value $\alpha 2$ to 1 when the scene changes, and does not adjust the luminance of the display image in step S115. In FIG. 18, a horizontal axis is the gray level of the pixel data, and a vertical axis is the number of accumulated pixel data at each gray level.

Figure 20:
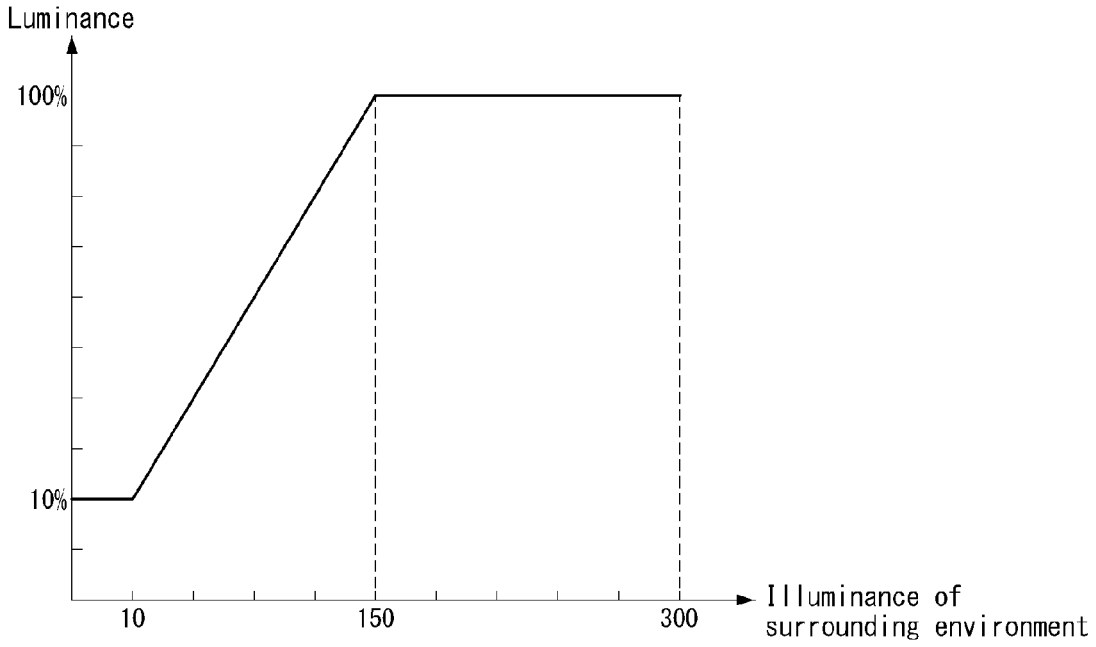
FIG. 20 shows a luminance of a display image depending on an illuminance of a surrounding environment.

FIG. 19 is a flow chart showing an operation of the third luminance adjusting unit 54. FIG. 20 shows the luminance of the display image depending on the illuminance of the surrounding environment.

As shown in FIGS. 19 and 20, the third luminance adjusting unit 54 receives an output signal of the illuminance sensor and decides the illuminance of the surrounding environment in step S121. The third luminance adjusting unit 54 adjusts the maximum luminance of the display image in proportion to the illuminance of the surrounding environment using the third weight value $\alpha 3$ in some of the APL sections in steps S122 to 125. For example, as shown in FIG. 20, when the illuminance of the surrounding environment is about 10 to 150 lux, the third luminance adjusting unit 54 increases the maximum luminance of the display image using the third weight value $\alpha 3$ as the illuminance of the surrounding environment increases, and reduces the maximum luminance of the display image using the third weight value $\alpha 3$ as the illuminance of the surrounding environment is reduced. When the illuminance of the surrounding environment is less than about 10 lux, the third luminance adjusting unit 54 maintains the maximum luminance of the display image to about 10%. When the illuminance of the surrounding environment is greater than about 150 lux, the third luminance adjusting unit 54 maintains the maximum luminance of the display image to about 100%.

The third luminance adjusting unit 54 may adjust the color temperature of the display image depending on the illuminance and the color temperature of the surrounding environment. The color temperature may be adjusted using the third weight value $\alpha 3$, which is independently set with respect to red (R), green (G), and blue (B) colors. For example, when the illuminance of the surrounding environment is about 0 to 50 lux, the third luminance adjusting unit 54 may maintain the color temperature of the display image to a specific color temperature, for example, about 10,000 K. When the illuminance of the surrounding environment is about 50 to 300 lux, the third luminance adjusting unit 54 may adjust the color temperature of the display image to about 7,000 to 11,000 K. When the illuminance of the surrounding environment is equal to or greater than about 300 lux, the third luminance adjusting unit 54 may maintain the color temperature of the display image to a specific color temperature, for example, about 11,000 K or 13,000 K.

The third luminance adjusting unit 54 may adjust the color temperature of the display image in proportion to the color temperature of the surrounding environment. In other words, the third luminance adjusting unit 54 reduces the color temperature of the display image when the color temperature of the surrounding environment is lowered, and increases the color temperature of the display image when the color temperature of the surrounding environment increases.

Figure 22:
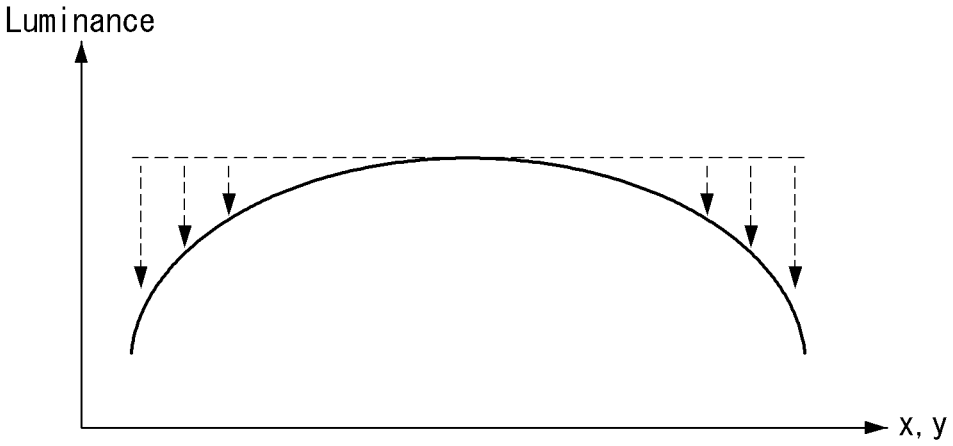
FIG. 22 shows an example of less reducing a luminance of a peripheral portion than a middle portion of a screen of a display panel in FIG. 2.

FIGS. 21 and 22 show an operation of the fourth luminance adjusting unit 56.

As shown in FIGS. 21 and 22, the fourth luminance adjusting unit 56 calculates the fourth weight value α4, which gradually reduces the luminance of the display image as it goes from the middle portion of the screen of the display panel 10 or the screen of the display image to the peripheral portion. Namely, the fourth weight value α4 in the middle portion is greater than the fourth weight value α4 in the peripheral portion. The fourth weight value α4 may be calculated based on a result of the analysis of the input image in steps S131 to S133. For example, the fourth luminance adjusting unit 56 analyzes the complexity of the input image. The fourth luminance adjusting unit 56 greatly reduces the fourth weight value α4 to be applied to the peripheral portion of the screen when the input image has the relatively large complexity, and slightly reduces the fourth weight value α4 to be applied to the peripheral portion of the screen when the input image has the relatively small complexity. This is because the user is less sensitive to changes in the luminance of the display image when the complexity of the input image increases. The complexity of the input image may be calculated by the number of edges such as boundaries, or the number of recognizable colors, etc., but is not limited thereto.

Figure 23:
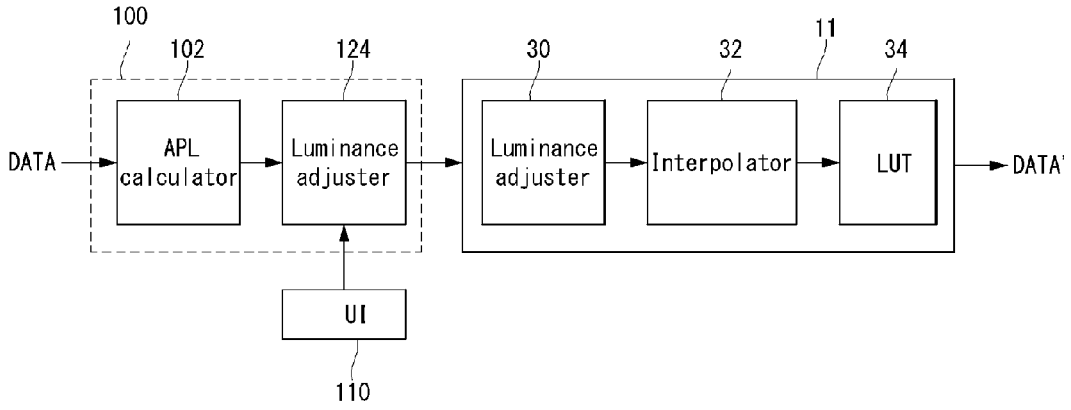
FIGS. 23 and 24 show an example where a portion of a luminance adjuster shown in FIG. 5 is embedded in a timing controller.
Figure 24:
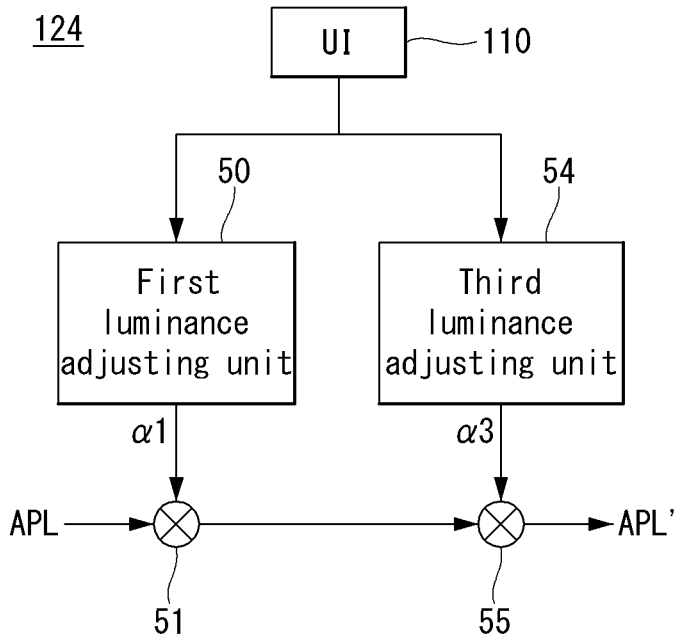
Figure 24:
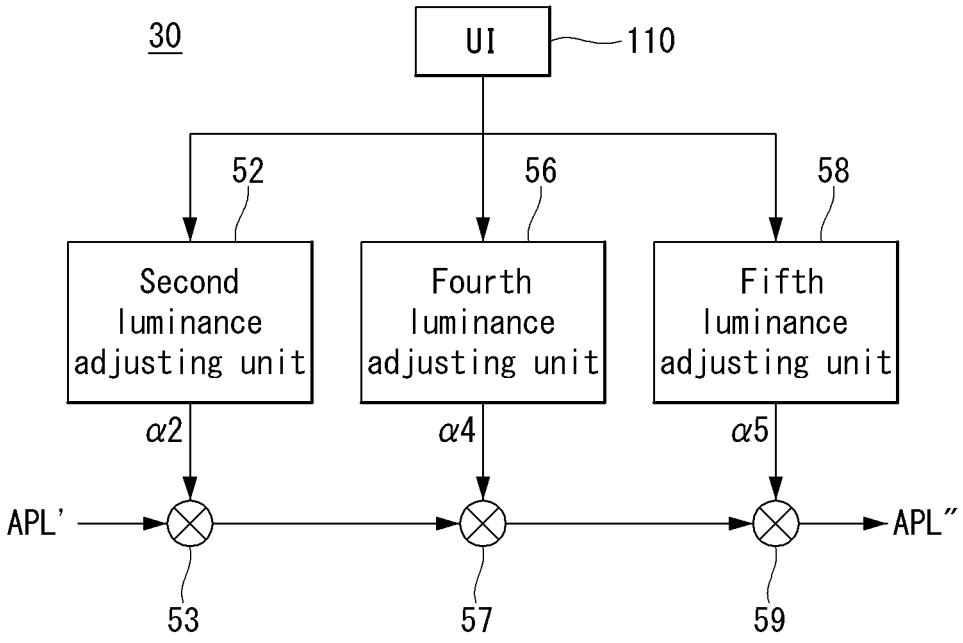

As shown in FIGS. 23 and 24, a portion of the luminance adjuster 104 may be embedded in the graphic controller of the host system 100, and the remaining portion may be embedded in the timing controller 11.

A luminance adjuster 124 embedded in the host system 100 includes the first and third luminance adjusting units 50 and 54 and the first and third multipliers 51 and 55.

As shown in FIGS. 12 and 13, the first luminance adjusting unit 50 sets the first weight value α1 in response to the UI input luminance input through the user interface 110 and adjusts the luminance of the display image. In this instance, when the UI input luminance is zero, the maximum luminance of the display image is limited to a value greater than zero. The first multiplier 51 adjusts the luminance of the APL point by multiplying the luminance of the input APL by the first weight value α1. As shown in FIG. 14, the first luminance adjusting unit 50 may adjust the maximum luminance of the display image based on the picture sound mode PSM.

As shown in FIGS. 19 and 20, the third luminance adjusting unit 54 adjusts the luminance of the display image based on the peripheral illuminance of the display device, thereby reducing the power consumption and preventing the user from glaring. The third luminance adjusting unit 54 adjusts the luminance of the display image using the third weight value α3. The third multiplier 55 adjusts the luminance of the APL point by multiplying the luminance of the input APL received from the first multiplier 51 by the third weight value α3.

The luminance adjuster 124 transmits the pixel data of the input image and the APL curve data APL' including the APLs of the APL points p0 to p7 to the timing controller 11.

The timing controller 11 includes a luminance adjuster 30, an interpolator 32, and a data modulator 34.

The luminance adjuster 30 adjusts the APL point at each of the APL points of the APL curve data APL' received from the host system 100. The luminance adjuster 30 includes the second, fourth, and fifth luminance adjusting units 52, 56, and 58 and the second, fourth, and fifth multipliers 53, 57, and 59.

The second luminance adjusting unit 52 adjusts the luminance of the display image based on the motion of the input image and the APL using the second weight value α2 through the same method as FIGS. 15 to 18. The second luminance adjusting unit 52 may not adjust the luminance of the display image when the scene changes. The second luminance adjusting unit 52 adjusts the luminance of the display image using the second weight value α2. The second multiplier 53 adjusts the luminance of the APL point by multiplying the luminance of the input APL point by the second weight value α2.

The fourth luminance adjusting unit 56 gradually reduces the luminance using the fourth weight value α4 as it goes from the middle portion of the screen of the display panel 10 to the peripheral portion, thereby reducing the power consumption. The fourth multiplier 57 adjusts the luminance of the APL point by multiplying the luminance of the input APL point by the fourth weight value α4.

The fifth luminance adjusting unit 58 causes the luminance of the display image in the store mode to be greater than the home mode using the fifth weight value α5. The fifth multiplier 59 adjusts the luminance of the APL point by multiplying the luminance of the input APL point by the fifth weight value α5.

The interpolator 32 receives the APL points p0 to p7 from the fifth multiplier 59 and generates APL curve data APL" through the linear interpolation method. The interpolator 32 supplies the APL curve data APL" to the data modulator 34. The data modulator 34 modulates the gray levels of the pixel data of the input image based on the APL curve data APL" and thus may adjust the luminance or the color temperature of the display image.

As described above, the embodiment of the invention selectively sets at least one luminance adjusting unit, which properly reduces the luminance of the display image displayed on the display panel in consideration of the image quality of the display device, using the user interface. As a result, the embodiment of the invention may minimize the reduction in the image quality of the display device and may reduce the power consumption.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

an average picture level (APL) calculator configured to calculate an APL of an input image and output the APL of the input image and an APL curve data;

a luminance adjuster including at least two luminance adjusting units, which are enabled in response to a user input through a user interface, the luminance adjuster adjusting the APL curve data;

a data modulator configured to modulate data of the input image using a luminance defined in the APL curve data adjusted by the luminance adjuster; and a display panel driving circuit configured to write data from the data modulator on a display panel and reproduce the input image on the display panel, wherein the luminance adjuster includes:

a first luminance adjusting unit configured to generate a first weight value, which is set based on an input luminance input through a user interface;

a first multiplier configured to multiply the APL curve data by the first weight value;

a second luminance adjusting unit configured to decide a motion of the input image and generate a second weight value, which reduces a maximum luminance of the display image as a motion of the input image increases; and a second multiplier configured to multiply the APL curve data received from the first multiplier by the second weight value.

2. The display device of claim 1, wherein the APL curve data includes only N APL points on an APL curve, where N is a positive integer between 2 and 20, wherein the N APL points are points positioned at boundaries between neighboring sections when the APL curve is equally divided into N sections.

3. The display device of claim 2, wherein the luminance adjuster multiplies the APL points by a weight value generated from the selected luminance adjusting unit and adjusts the APL points.

4. The display device of claim 3, further comprising an interpolator configured to linearly interpolate the APL points adjusted by the luminance adjuster, produce data connecting the neighboring APL points, and output an adjusted APL curve data defining the maximum luminance of a display image reproduced on the display panel on the entire APL curve to the data modulator.

5. The display device of claim 4, wherein the first multiplier multiplies the APL point by the first weight value, and wherein the second multiplier multiplies the APL point received from the first multiplier by the second weight value.

6. The display device of claim 5, wherein when the input luminance is zero, the first luminance adjusting unit limits the maximum luminance of the display image to a value greater than zero.

7. The display device of claim 6, wherein as the APL curve data is reduced, the second luminance adjusting unit reduces the second weight value and reduces the maximum luminance of the display image.

8. The display device of claim 7, wherein the second luminance adjusting unit maintains a luminance of the display image when a scene change is generated in the input image.

9. The display device of claim 5, wherein the luminance adjuster includes:

a third luminance adjusting unit configured to sense a peripheral illuminance and generate a third weight value proportional to the peripheral illuminance; and a third multiplier configured to multiply the luminance of the APL point received from one of the first multiplier and the second multiplier by the third weight value.

10. The display device of claim 9, wherein the third luminance adjusting unit senses a color temperature of a surrounding environment and adjusts a color temperature of the display image in proportion to the color temperature using the third weight value.

11. The display device of claim 10, wherein the luminance adjuster includes:

a fourth luminance adjusting unit configured to generate a fourth weight value which gradually reduces the luminance of the display image as it goes from a middle portion of the screen of the display panel to a peripheral portion thereof; and a fourth multiplier configured to multiply the luminance of the APL point received from one of the first multiplier, the second multiplier, and the third multiplier by the fourth weight value.

12. The display device of claim 11, wherein the luminance adjuster includes:

a fifth luminance adjusting unit configured to generate a fifth weight value which differently adjusts the luminance of the display image in a store mode and a home mode; and a fifth multiplier configured to multiply the luminance of the APL point received from one of the first multiplier, the second multiplier, the third multiplier, and the fourth multiplier by the fifth weight value, wherein the luminance of the display image in the store mode is set to be greater than the luminance of the display image in the home mode.

13. A method for controlling a luminance of a display device comprising:

calculating an average picture level (APL) of an input image;

adjusting an APL curve data;

modulating data of the input image using a luminance defined in the adjusted APL curve data; and writing the modulated data on a display panel to reproduce the input image on the display panel, wherein the adjusting an APL curve data includes:

generating a first weight value, which is set based on an input luminance input through a user interface;

multiplying the API curve data by the first weight value to generate a first adjusted APL curve data;

deciding a motion of the input image;

generating a second weight value, which reduces a maximum luminance of the display image as a motion of the input image increase; and multiplying the first adjusted APL curve data by the second weight value.

14. The method of claim 13, wherein the APL curve data includes only N APL points on an APL curve, where N is a positive integer between 2 and 20, wherein the N APL points are points positioned at boundaries between neighboring sections when the APL curve is equally divided into N sections.

15. The method of claim 14, further comprising:

generating a weight value for adjusting a luminance of a display image; and multiplying the APL points by the weight value to adjust the APL points.

16. The method of claim 15, further comprising linearly interpolating the adjusted APL points, producing data connecting the neighboring APL points, and generating the adjusted APL curve data.

* * * * *